United States Patent [19]

De Faveri

[11] Patent Number: 4,575,079

[45] Date of Patent: Mar. 11, 1986

[54] ARTICULATED RESILIENTLY-BIASED MOUNTED MEANS FOR BASKETBALL HOOP

[76] Inventor: Umberto De Faveri, Via Garibaldi 41/a, 34074 Monfalcone (Go), Italy

[21] Appl. No.: 707,382

[22] Filed: Mar. 1, 1985

[30] Foreign Application Priority Data

Mar. 13, 1984 [IT] Italy ..... 83334 A/84

[51] Int. Cl.[4] ..... A63B 63/08

[52] U.S. Cl. ..... 273/1.5 R

[58] Field of Search ..... 273/1.5 R, 1.5 A; 172/264–268

[56] References Cited

U.S. PATENT DOCUMENTS

| | | | |
|---|---|---|---|
| 2,786,678 | 3/1957 | Fink | 273/1.5 R |
| 4,111,420 | 9/1978 | Tyner | 273/1.5 R |
| 4,433,839 | 2/1984 | Simonseth | 273/1.5 R |
| 4,438,923 | 3/1984 | Engle et al. | 273/1.5 R |
| 4,441,709 | 4/1984 | Schroeder et al. | 273/1.5 R |

*Primary Examiner*—Paul E. Shapiro

*Attorney, Agent, or Firm*—Leonard Bloom

[57] ABSTRACT

An articulated resiliently-biased mounting is provided for a basketball hoop. The mounting includes three brackets nested relative to each other. A first bracket is secured to the backboard. A second bracket, constituting an intermediate bracket, is pivotably supported on the first bracket. A first spring constantly urges the second bracket towards its normally nested position relative to the first bracket. A third bracket is pivotably supported on the second intermediate bracket. The third bracket is secured to the annular rim of the basket. A second spring, independent of the first spring, constantly urges the third bracket towards its normal position relative to the second bracket. As a result, the rim may deflect, but readily returns to its normal horizontal position relative to the backboard.

6 Claims, 3 Drawing Figures

ARTICULATED RESILIENTLY-BIASED MOUNTED MEANS FOR BASKETBALL HOOP

FIELD OF THE INVENTION

The present invention relates to a mounting means for a basketball hoop, and more particularly, to an improved mounting means which provides a pair of resilient mountings independently operable of one another.

BACKGROUND OF THE INVENTION

At the present state of the art, the design and structure of the apparatus used in the game of basketball is well known. This apparatus includes a metallic hoop or rim of predetermined and sufficient diameter to permit the ball to drop through a woven net or "basket" depending from the rim, thereby making a score. The rim is welded or otherwise secured to a plate or supporting bracket which in turn is secured by screws or bolts to a backboard. The backboard is arranged vertically at a suitable height above the floor and is usually carried by a trestlework or suitable frame. The basketball may be rebounded against the backboard and through the rim and basket in making a score. The rim is usually disposed at the center of the lower edge of the vertical backboard and projects horizontally therefrom.

It is also known that a score can be made, not only by rebounding the ball against the backboard, but also directly without hitting the backboard. These are the so-called "over-the-rim shots", which are frequently used by a player. In these shots, the player takes advantage of his height and jumps and shoots or else lays the ball over the rim of the basket.

The structures heretofore resorted to in the prior art have an inherent stiffness or rigidity, which is a disadvantage. As a result, frequent breakages occur which delay the game and necessitate expensive repairs. Additionally, breakage of the backboard will involve a serious risk to the safety of the players and, possibly, the spectators.

Moreover, the supporting structure may tend to bend or deform, so that the basket is no longer horizontal. As a result, unsportsmanlike players may tend to "hang themselves" to the hoop for deforming it in their favor, even if this conduct is prohibited and penalized.

SUMMARY OF THE INVENTION

The object of the present invention is to obviate the above-mentioned disadvantages of the prior art by providing the basket with an improved resiliently-biased attachment means to the backboard.

Accordingly, the major advantages offered by this invention are as follows:

(1) The basket can be secured in the same manner as the conventional baskets;

(2) due to its flexibility, the basket is no longer deformable; and (3) attachment to the backboard is much safer and more reliable, thereby guarding against accidental breakage.

According to a preferred embodiment of the invention, if the basket is stressed by downward forces (e.g. player grasping at the hoop), the basket will pivotably deflect downwardly sufficiently to assure adequate cushioning (e.g. 30°) against the resilient force of the spring means; and the deflection is limited by a stop, beyond which the basket cannot bend. Failing stressing forces, the basket will return to its primary horizontal position as if nothing had happened.

The inherent elasticity of the structure of the present invention is also very advantageous in order to accommodate anomalous vibrations of the structure.

According to a preferred embodiment of the invention, the elastic force required for keeping the basket hoop horizontal varies from approximately 60 to 150 kg.

In accordance with the teachings of the present invention, there is herein illustrated and described, an improvement to a basketball hoop of the type having an annular rim adapted to be supported by a backboard. The improvement constitutes an articulated bracket means between the backboard and the rim. This articulated bracket means includes a first bracket secured to the backboard, and further includes a second bracket pivotably supported on the first bracket about a first substantially-horizontal axis. A first spring means is provided for constantly urging the second bracket in a direction towards the backboard and into a normal position nested relative to the first bracket. A third bracket is pivotably supported on the second bracket about a second substantially-horizontal axis spaced from the first axis, and means are provided for securing this third bracket to the annular rim. A second spring means is provided for constantly urging the third bracket into a normal position, wherein the annular rim assumes a substantially-horizontal position.

These and other objects of the present invention will become apparent from a reading of the following specification, taken in conjunction with the enclosed drawings.

DESCRIPTION OF THE PREFERRED EMBODIMENT

Figure 1:
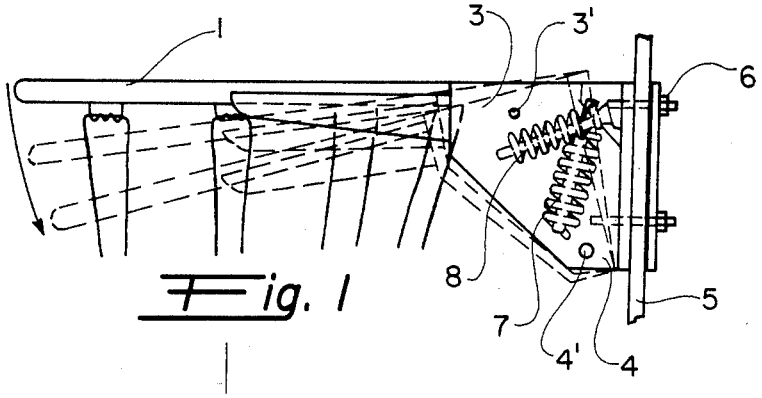
FIG. 1 is a side elevation of a basket mounted on the supporting backboard in accordance with the teachings of the present invention, the broken lines indicating the alternate position of the structure.

With reference to the drawings, the improved structure of the present invention includes a metallic rim 1 provided with eyelets 1'' for hooking the basket net 2. Preferably, the net 2 is provided with a suitable semiannular reinforcing member 1' which, in turn, is secured to a protruding C-shaped supporting bracket 1'''. Bracket 1''' is hinged, as at 3', for pivotable movement relative to an articulated box-like intermediate connection bracket 3. Bracket 3 has a top wall, end wall, and respective parallel side walls; and bracket 3 is hinged, as at 4', for pivotable movement on a C-shaped bracket 4. Bracket 4 is secured to the backboard 5 by suitable fasteners 6.

With this construction, C-shaped bracket 1''' may pivot on box-like intermediate bracket 3 about hinge 3'; and independently thereof, intermediate bracket 3 may pivot on C-shaped bracket 4 about hinge 4'. As used herein, brackets 4, 3 and 1''' are designated as the first, second and third brackets, respectively.

Figure 3:
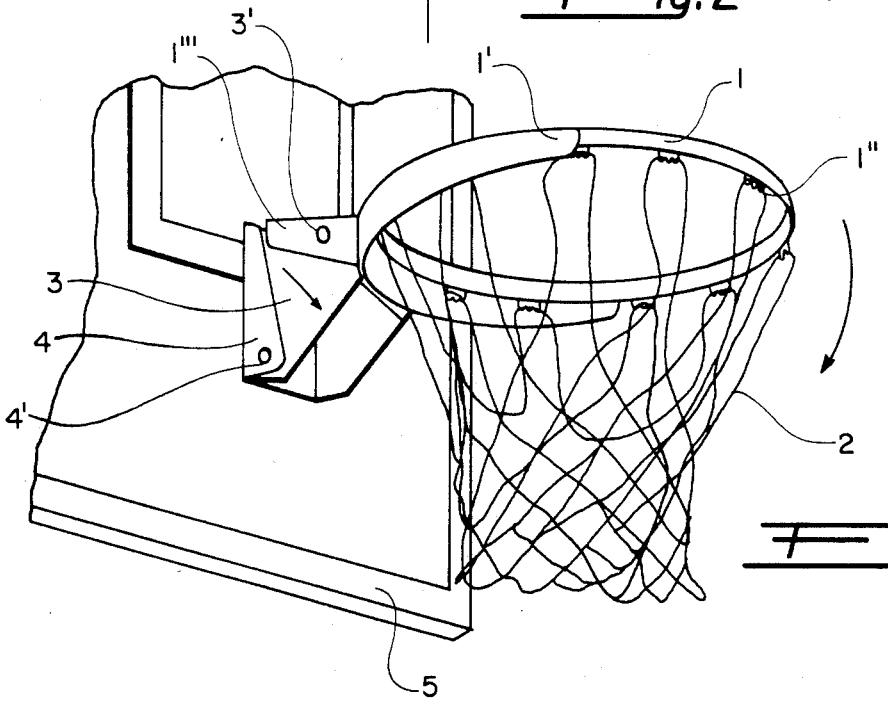
FIG. 3 is a perspective view thereof.

Suitable resilient means are provided between brackets 1''' and 3 and between brackets 3 and 4, respectively. The purpose of the resilient means is to maintain the brackets 1''', 3 and 4 nested relative to one another (as shown in FIG. 3 of the drawings) so that the rim 1 and hence the basket 2 will be maintained substantially horizontal relative to the backboard 5, but may deflect downwardly therefrom as indicated by the broken lines in FIG. 1.

Figure 2:
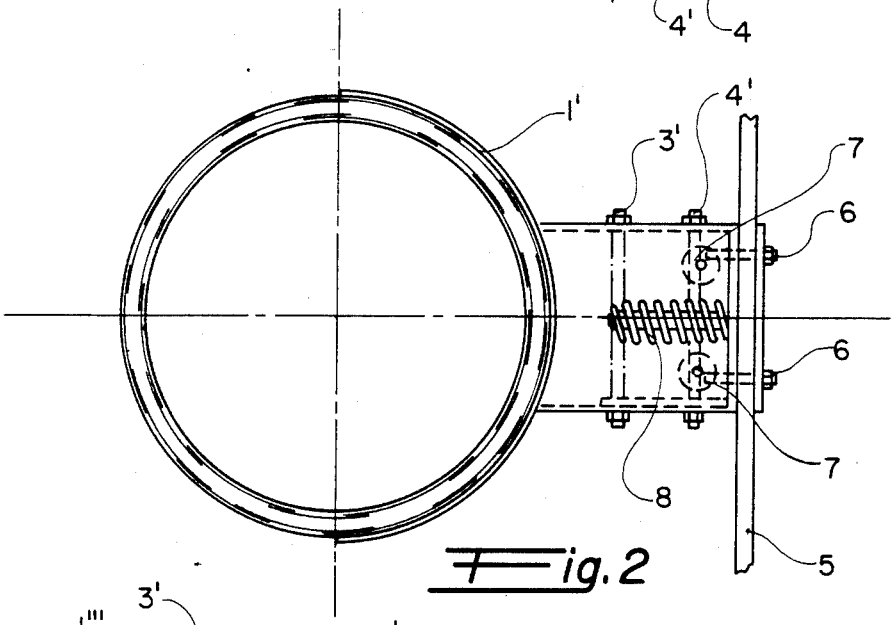
FIG. 2 is a top plan view of the structure of FIG. 1.

The resilient means between the bracket 1''' and the intermediate bracket 3, constituting a first spring means, preferably includes a pair of helical coil springs 7 (shown more clearly in FIG. 2). A rod is inserted within each of the coil springs (as shown more clearly in FIG. 1). One end of the rod is secured to the top wall of the C-shaped bracket 1'''. The rod extends through the top wall of the box-like intermediate bracket 3, and the respective coil spring is piloted on the rod. The other (or free) end of the rod carries a washer backed up by a nut threadably engaging the rod. The washer seats the end of the spring, and the nut adjusts the desired tension on the spring. With this arrangement, the bracket 1''' is constantly urged into its normal nested position (relative to the intermediate bracket 3) but may pivotably deflect therefrom about the hinge or pivot 3'.

The resilient means between the intermediate bracket 3 and the C-shaped bracket 4, constituting a second spring means, preferably includes a helical spring 8 piloted on a respective rod (as shown more clearly in FIG. 1). One end of the respective rod is secured to the back wall of the C-shaped bracket 4 adjacent to the backboard 5. The respective rod passes through a back wall on the box-like intermediate bracket 3. The free end of the respective rod carries a washer and a nut for adjusting the tension on spring 8, the spring 8 being seated between the washer and the back wall of the intermediate bracket 3. With this arrangement, the intermediate bracket 3 is constantly urged into its normal nested position (relative to the bracket 4) but may pivotably deflect therefrom about the hinge or pivot 4'.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. In a basketball hoop having an annular rim adapted to be supported by a backboard, the improvement of articulated bracket means between the backboard and the rim, which comprises a first bracket secured to the backboard, a second bracket pivotably supported on the first bracket about a first substantially-horizontal axis, first spring means for constantly urging the second bracket in a direction towards the backboard and into a normal position nested relative to the first bracket, a third bracket pivotably supported on the second bracket about a second substantially-horizontal axis spaced from the first axis, means for securing the annular rim to the third bracket, and second spring means for constantly urging the third bracket into a normal position wherein the annular rim assumes a substantially-horizontal position.

2. The improvement of claim 1, wherein the annular rim comprises a metallic hoop provided with eyelets for hooking a basket net.

3. The improvement of claim 1, further including respective pins along the first and second axes, and wherein the first and second spring means comprises helicoidal springs, respectively, for resistance and elastic returning action of said second and third brackets, respectively, in rotation about the first and second pins, respectively.

4. The improvement of claim 1, wherein the third bracket comprises a protruding C-shaped supporting bracket that is hinged on the second bracket, wherein the second bracket comprises an articulated intermediate connection box bracket which in turn is hinged to the first bracket, and wherein the first bracket comprises a C-shaped bracket fixed and supported by the backboard.

5. The improvement of claim 1, wherein the first bracket comprises a substantially C-shaped bracket, the second bracket comprises an articulated intermediate box bracket having a top wall and a back wall, respectively, and the third bracket comprises a protruding substantially C-shaped bracket; wherein the first spring means comprises a rod having one end thereof secured to the first C-shaped bracket and extending therefrom through the back wall of the intermediate box bracket, a first coil spring piloted on the rod within the intermediate box bracket and bearing against the back wall thereof, a washer on the other end of the rod for seating the other end of the first coil spring, and a nut on the rod adjacent to the washer for adjusting the tension of the first coil spring; and wherein the second spring means comprises a pair of second rods, each of the second rods having one end thereof secured to the third C-shaped bracket and extending downwardly therefrom through the top wall of the intermediate box bracket, a second coil spring piloted on each of the second rods and having one end thereof bearing against the top wall of the intermediate box bracket, a washer on the rod for seating the other end of the second coil spring, and a respective nut on the end of each of the second rods for adjusting the tension of the second coil springs.

6. In a basketball hoop having a rim adapted to be supported by a backboard the improvement which comprises a member disposed between the rim and the backboard, first means for pivotably mounting the member to the backboard about a first substantially horizontal axis, first resilient means for constantly urging the member towards the backboard, second means independent from the first means for pivotably mounting the rim to the member about a second substantially horizontal axis spaced from the first axis, and second resilient means for constantly urging the rim to an initial position relative to the member, whereby the rim and member may deflect downwardly independently of each other, and whereby the rim tends to return to a substantially horizontal position with respect to the backboard.

* * * * *